United States Patent [19]

Hidaka et al.

[11] Patent Number: 4,955,283

[45] Date of Patent: Sep. 11, 1990

[54] HYDRAULIC CIRCUIT FOR CYLINDER

[75] Inventors: Sachio Hidaka, Kakogawa; Hiroshi Shibata, Kobe; Hideaki Yoshimatu, Akashi, all of Japan

[73] Assignee: Kabushiki Kaisha Kobe Seiko Sho, Kobe, Japan

[21] Appl. No.: 316,131

[22] Filed: Feb. 27, 1989

[30] Foreign Application Priority Data

Mar. 3, 1988 [JP] Japan ..... 63-28563[U]

[51] Int. Cl.[5] ..... F15B 11/08

[52] U.S. Cl. ..... 91/447; 91/461

[58] Field of Search ..... 91/461, 447; 60/477, 60/481

[56] References Cited

U.S. PATENT DOCUMENTS

| | | | |
|---|---|---|---|
| 3,805,678 | 4/1974 | Bianchetta et al. | 91/461 X |
| 4,088,151 | 5/1978 | Schurger | 91/447 X |
| 4,194,532 | 3/1980 | Hall | 91/447 X |
| 4,204,459 | 5/1980 | Johnson . | |
| 4,391,183 | 7/1983 | Broms et al. | 91/461 |
| 4,417,502 | 11/1983 | Shore | 91/447 |
| 4,509,406 | 4/1985 | Melocik | 91/461 X |
| 4,571,941 | 2/1986 | Aoyagi et al. | 91/461 X |
| 4,753,158 | 6/1988 | Hirata et al. | 91/461 |

FOREIGN PATENT DOCUMENTS

| | | | |
|---|---|---|---|
| 019597 | 11/1980 | European Pat. Off. . | |
| 2314590 | 9/1974 | Fed. Rep. of Germany . | |
| 3128044 | 2/1983 | Fed. Rep. of Germany | 91/447 |
| 15104 | 1/1982 | Japan | 91/447 |
| 186804 | 8/1986 | Japan . | |

*Primary Examiner*—Edward K. Look

*Attorney, Agent, or Firm*—Oblon, Spivak, McClelland, Maier & Neustadt

[57] ABSTRACT

A hydraulic circuit suitable for use on power shovel or other construction machines, more specifically a hydraulic circuit for a cylinder in a hydraulic power transmission, of the type which is adapted to control pressurized oil flows to and from two oil chambers in the cylinder by switching the position of a directional control valve in communication with a pressurized oil source. The hydraulic circuit includes a logic valve provided between the directional control valve and a load-holding oil chamber in the cylinder. The logic circuit has first and second ports connected to the directional control valve and said load-holding oil chamber, respectively. A selector valve is responsive to the switching of the directional control valve to communicate a spring chamber of the logic valve with a conduit between the first port and the directional control valve in an operational phase of supplying pressurized oil to a load lowering chamber of the cylinder and to communicate the spring chamber with the second port in other operational phases.

4 Claims, 3 Drawing Sheets

HYDRAULIC CIRCUIT FOR CYLINDER

BACKGROUND OF THE INVENTION

1. Field of the Invention

This invention relates to a hydraulic circuit suitable for use with power cylinders on construction machines such as hydraulic power shovels and the like.

2. Description of the Prior Art

In the hydraulic circuit of power cylinder which holds a load with oil pressure in an oil chamber on the side of the cylinder head, it has been known to provide a logic valve between the oil chamber on the side of the cylinder head and a direction control valve in order to prevent the load from dropping spontaneously by contraction of the cylinder due to oil leaks when the direction control valve is in neutral position, and to add a damping valve to the logic valve in order to prevent the hunting which would occur when contracting the cylinder for lowering the load, as proposed, for example, in Japanese Laid-Open Utility Model Application No. 61-186804.

With the above-described conventional arrangement, when contracting the cylinder, a pilot pressure change-over valve is switched into a communicating position by the pressure in an oil pressure supply duct leading to an oil chamber on the rod side of the cylinder, thereby draining the oil in a spring chamber of the logic valve into the tank to open the logic valve, and then draining the oil in the oil chamber on the side of the cylinder head to the tank through the logic valve and the direction control valve to contract the cylinder. Therefore, in the initial stage of contraction, the cylinder is contracted momentrarily irrespective of the degree of opening of the direction control valve spool to an extent corresponding to the opening stroke volume (the amount of oil drained to the tank from the spring chamber) of the logic valve poppet, creating a dangerous situation of dropping the load momentarily.

Besides, when extending the cylinder, the pilot change-over valve is in blocking position and the logic valve is in locked state, so that it is necessary to provide a check valve parallel with the logic valve to supply pressure to the oil chamber on the side of the cylinder head. This check valve has to be of a large diameter as the flow rate of the pressurized oil to the oil chamber on the side of the cylinder head is greater than to the oil chamber on the rod side. In addition, the logic valve with the adjuvant damping cylinder makes the construction complicated while the provision of the check valve of a large diameter for the logic valve increases the number of parts, which will be eventually reflected by an increase in cost.

Further, the pilot change-over valve which brings the spring chamber of the logic valve into and out of communication with the tank is of the spool type which inevitably entails oil leaks even in blocking position, which might cause spontaneous contraction of the cylinder and drop of the load.

SUMMARY OF THE INVENTION

It is an object of the present invention to provide a hydraulic circuit for power cylinder, which can eliminate the above-mentioned problems of the prior art, namely, which is simplified in construction and reduced in the number of parts and cost and which precludes the momentary drop of load in an initial stage of lowering operation and to prevent hunting in the succeeding stage to ensure smooth lowering of the load. It is another object of the invention to provide a hydraulic circuit for a cylinder, which can ensure a high degree of safety in operation, preventing spontaneous drop of upheld loads.

In accordance with the present invention, the above-stated objectives are attained by the provision of a hydraulic circuit of the type which is adapted to control pressurized oil flows to and from the two oil chambers in the cylinder by switching the position of a direction control valve which is in communication with a pressurized oil source, the hydraulic circuit comprising: a logic valve provided between the direction control valve and a load-holding oil chamber in the cylinder, and having first and second ports connected to the direction control valve and the load-holding oil chamber, respectively; and a selector valve operable in relation with the switching operation of the direction control valve to communicate the spring chamber of the logic valve with a conduit between the first port and the direction control valve in an operational phase of supplying pressurized oil to the load lowering chamber of the cylinder and to communicate the spring chamber with the second port in other operational phases.

With this arrangement, the direction control valve is constituted by a pilot change-over valve which is switched by pilot pressure from a pilot operating valve.

Similarly, the selector valve is constituted by a pilot change-over valve which is switched by pilot pressure from the pilot operating valve, at a predetermined switching pressure level which is lower than the predetermined switching level for the direction control valve. Preferably, the selector valve is constituted by a seat valve.

In the hydraulic circuit arrangement according to the invention, the selector valve is switched when lowering a load to communicate the spring chamber of the logic valve with a conduit between the first port of the logic valve and the direction control valve, thereby draining the oil in the spring chamber directly to the tank. Accordingly, it becomes possible to prevent the momentary drop of load which has been conventionally experienced in an initial stage of a load lowering operation. Further, in the succeeding lowering control following the switching of the selector valve, the direction control valve is switched into a position in which the load lowering speed of the cylinder is appropriately controlled according to the spool stroke of the direction control valve. Thus, the hunting can be prevented suitably without resorting to a damping cylinder and check valve as in the prior art. This means that it becomes possible to provide a simplified construction with a reduced number of parts and to cut the cost. Moreover, spontaneous drops of loads can be prevented in a reliable manner by the use of a selector valve which is constituted by a seat valve.

The above and other objects, features and advantages of the invention will become apparent from the following description and the appended claims, taken in conjuction with the accompanying drawings which illustrate by way of example preferred embodiments of the invention.

DESCRIPTION OF PREFERRED EMBODIMENTS

Figure 1:
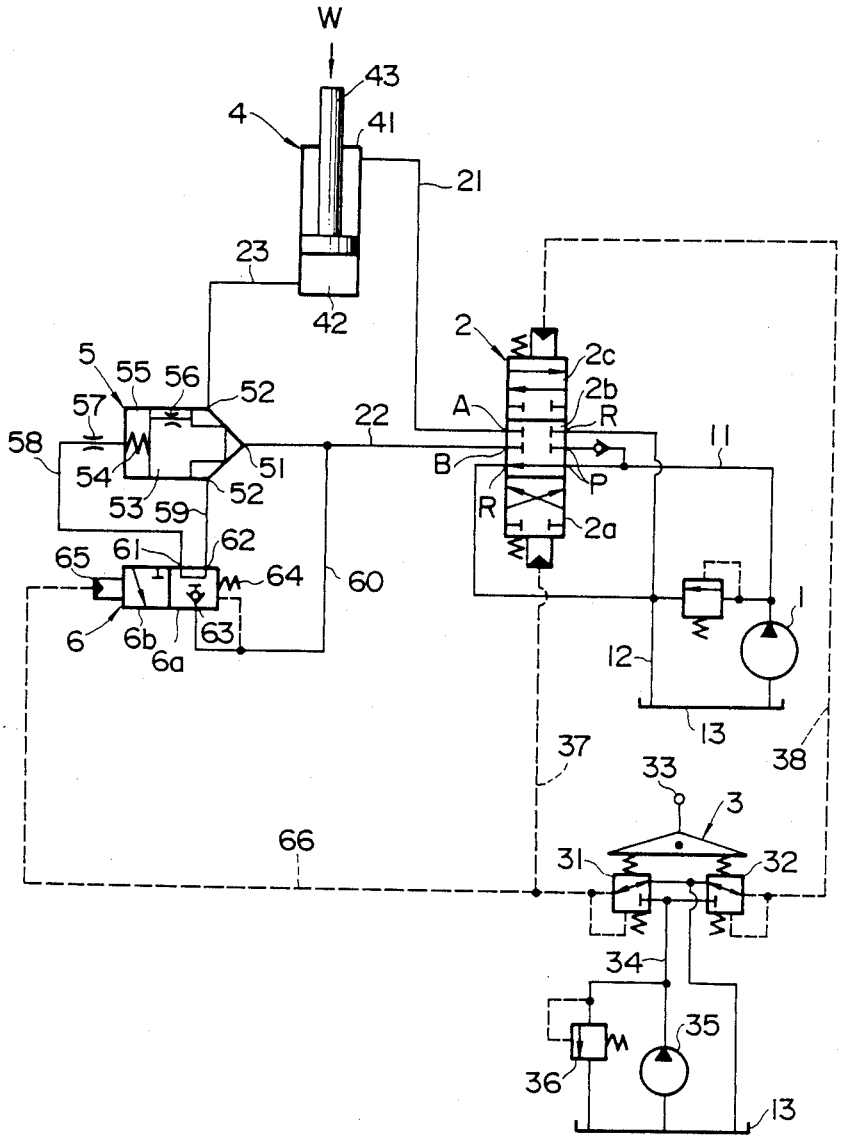
FIG. 1 is a hydraulic circuit diagram in an embodiment of the invention.

Referring to FIG. 1, there is illustrated an embodiment of the invention, wherein indicated at 2 is a direction control valve which has its P port connected to a main pump 1 (a pressurized oil source) through a pump duct 11, R port connected to a tank 13 through a return oil duct 12, A port connected to a rod-side oil chamber (a load lowering oil chamber) of a cylinder 4 through a duct 21, and B port connected to a first port 51 of a logic valve 5 through a duct 22. Oil chamber 42 (a load holding oil chamber) on the head side of the cylinder 4 is connected to a second port 52 of the logic valve 5 through a duct 23.

The direction control valve 2 is constituted by a pilot change-over valve which is switchable by the pilot pressure from a pilot operating valve 3. This pilot operating valve 3 includes a pair of variable reducing valves 31 and 32 which control the pilot pressure which is produced on the secondary side according to the extent of manipulation of a lever 33. The primary side of the pilot operating valve 3 is connected to a pilot pump 35 and a pilot relief valve 36 through a duct 34, while the secondary side is connected to switching pilot ports of the direction control valve 2 through pilot ducts 37 and 38.

Poppet 53 in the spring chamber 54 of the logic valve 5 is urged in the closing direction by a spring 55, and provided with an orifice 56 which communicates the second port 52 with the spring chamber 54.

Selector valve 6 is a pilot type 3-port 2-position change-over valve with its port 61 connected to the spring chamber 54 of the logic valve 5 through a conduit 58 with an orifice 57, port 62 connected to the second port 52 of the logic valve 5 through a conduit 59, and port 63 connected to a conduit 22 between the first port 51 of the logic valve 5 and the direction control valve 2 through conduit 60. This selector valve 6 is normally urged into the position 6*a* shown, by the action of spring 64, and switched into the left position 6*b* in the drawing when the pilot pressure to the pilot port 65 exceeds a predetermined level. Connected to the pilot port 65 is a pilot conduit 66 which is branched off the switching pilot conduit 37 of the above-described direction control valve 2.

Figure 2:
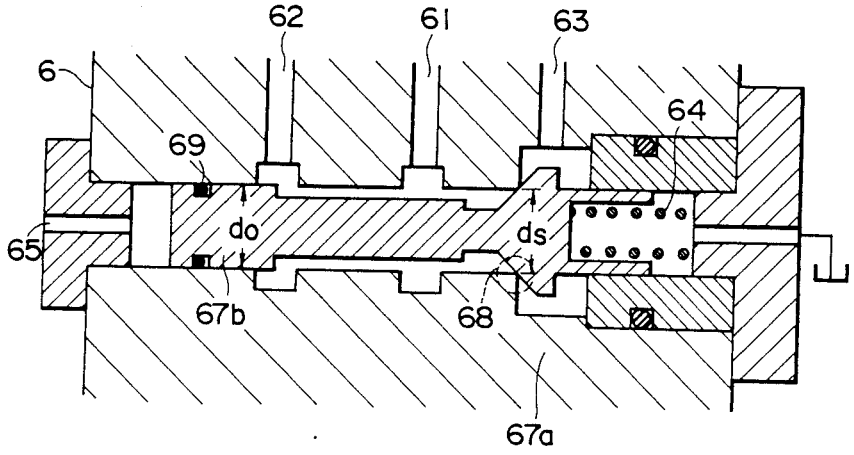
FIG. 2 is a sectional view of a particular example of the selector valve.

The selector valve 6 is constituted by a seat valve, i.e., a valve having a seat, as shown in FIG. 2, in which indicated at 67*a* is a valve body, at 67*b* is a spool, at 68 is a seat portion, and at 69 is a seal which shields off the ports 62 and 65 from each other.

Figure 3:
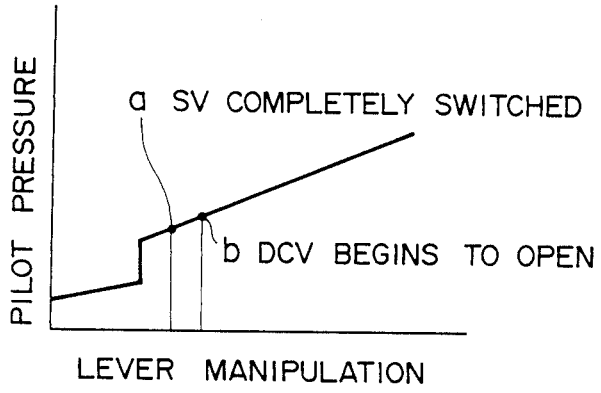
FIG. 3 is a diagram showing the extent of lever manipulation of the pilot operating valve in relation with the pilot pressure and switching timings of the selector valve and the direction control valve.

The switching pressure of the selector valve 6 is preset at a level which is lower than the switching pressure level of the direction control valve 2. In this connection, FIG. 3 shows the extent of lever operation (the angle of operation) of the pilot operating valve 3 in relation with the output pilot pressures to the conduits 37 and 66 and the switching timings of the direction control valve 2 and selector valve 6. In FIG. 3, the selector valve 6 is completely switched to the position 6*b* at point (a) and then the direction control valve 2 begins to open at point (b).

The hydraulic circuit of the invention operates in the manner as follows.

I. Lowering load (contraction of cylinder 4)

Upon turning the lever 33 of the pilot operating valve 3 counterclockwise by manipulation, a pilot pressure commensulate with the extent of lever manipulation is led to the pilot conduits 37 and 66 from the secondary side of the variable reducing valve 31. Since the switching pressure of the selector valve 6 is preset at a lower level than the switching pressure of the direction control valve 2, the selector valve 6 is firstly switched to the left position 6*b* in the drawing (at point (a) of FIG. 3) to communicate the conduit 58 with the conduit 60 and to bring the spring chamber 54 of the logic valve 5 into communication with the conduit 22.

In this initial stage of operation, however, the direction control valve 2 is still retained in the neutral position 2*b* and the conduit 22 is blocked by the direction control valve 2. Therefore, the oil in the spring chamber 54 of the logic valve 5 does not flow into the tank 13, and the logic valve 5 is still held in closed state by the spring 55. Consequently, the oil in the oil chamber on the head side of the cylinder 4 does not flow into the tank 13, and the cylinder 4 is in stopped state, holding the load W at rest.

Thereafter, as the lever is turned further, the pilot pressure to the conduit 66 and 37 is elevated to switch the direction control valve 2 to the lowering position 2*a* (at or past the point (b) in FIG. 3), communicating the conduit 11 with the conduit 21 and at the same time communicating the conduit 22 with the tank 13 through the return conduit 12. At this time, the selector valve is continuedly held in the left position 6*b*, holding the spring chamber 54 of the logic valve 5 in communication with the conduit 22.

Consequently, the discharge oil of the pump 1 flows into the rod-side oil chamber 41 of the cylinder 4, pushing down the piston rod 43 and increasing the pressure in the head-side oil chamber 42 to open the poppet 53 of the logic valve 5. Therefore, the oil in the head-side oil chamber 42 is led to the conduit 22 through the logic valve 5 and then into the tank 13 through the direction control valve 2, contracting the cylinder 4 to lower the load W.

As the poppet 53 of the logic valve 5 is moved open by the load holding pressure in the head-side oil chamber 42 of the cylinder 4 in the initial stage of the load lowering operation, the oil in the spring chamber 55 flows out into the conduit 58 through the orifice 57. Without being directly drained to the tank 13, this outflowing oil is led to the conduit 22 through the conduit 60 to join the oil which has been led from the head-side oil chamber 42 to the conduit 22 through the logic valve 5, and flows into the tank 13 under flow rate (metering) control by the direction control valve 2. Therefore, the lowering of the load W is commenced smoothly, without causing a mementary drop of the load W in the initial stage of the lowering operation.

Thereafter, the logic valve 5 is held open, and the open degree of the spool of the direction control valve 2 is controlled according to the extent of lever manipulation, thereby controlling the inflow rate to the rod-side oil chamber 41 of the cylinder 4 and the outflow rate from the head-side oil chamber 42 to the tank 13 in proportion to the spool open degree for control of the contraction of the cylinder 4 or the lowering speed of the load W. Therefore, there is no need for allotting a flow controlling (metering) function to the poppet 53 of the logic valve. Namely, there is no need for providing a damping means as in the conventional circuits, so that the number of parts can be reduced for cost reduction. In addition, the metering control of the direction control valve 2 preclude the hunting as mentioned hereinbefore, ensuring smooth contraction of the cylinder 4 and lowering of the load W.

II. Holding load (stopping cylinder 4)

Upon returning the lever 33 is to neutral position, the direction control valve 2 is returned to the neutral position 2*b*, and then the selector valve 6 is returned to the position 6*a* shown in the drawing. As a result, the discharge oil of the pump 1 is returned to the tank 13, and the conduits 21 and 22 are blocked, stopping the supply of pressurized oil to the rod-side oil chamber 41 of the cylinder 4 and blocking the oil flow from the conduit 22 to the tank 13 to stop the cylinder 4 in a predetermined position.

At this time, the load holding pressure in the head-side oil chamber 42 of the cylinder 4 is led to the second port 52 of the logic valve 5 from the conduit 23 to urge the logic valve poppet 53 in the opening direction. However, since the second port 52 is in communication with the spring chamber 55 through the orifice in the poppet and the position 6*a* of the selector valve 6, the load holding pressure also prevails in the spring chamber 55 to counteract the pressure on the opposite side of the poppet 53. Therefore, the poppet 53 is biased in the closing direction by the spring 55 to close the logic valve 5, preventing the oil in the head-side oil chamber 42 from flowing into the conduit 22, to hold the cylinder 4 securely in the stop position.

The selector valve 6, which is constituted by a seat valve, securely prevents oil flows from the second port 52 and spring chamber 55 of the logic valve 5 into the conduits 60 and 22 by its seat portion 68 of FIG. 2 in the left position 6*a*, while preventing oil flows to the pilot port 65 securely by the seal 69 to hold the logic valve 5 securely in a closed state. Accordingly, the cylinder 4 is securely retained in the stop position, completely free of the contraction caused by oil leaks as experienced with conventional cylinders, or spontaneous drop of the load W.

III. Lifting load (extension of cylinder):

When the lever 33 is turned clockwise, the variable reducing valve 32 produces a pilot pressure commensurate with the extent of lever manipulation to the conduit 38 on its secondary side. By this pilot pressure, the direction control valve 2 is switched to the lifting position 2*c*, leading the discharge oil of the pump 1 to the conduit 22 and to the first port 51 of the logic valve 5.

At this time, the pilot conduit 66 is not supplied with the pilot pressure, so that the selector valve 6 is retained in the position 6*a* shown in the drawing by the action of the spring 64 in a manner similar to the operation II described above, communicating the spring chamber 54 and second port 52 of the logic valve 5 through the conduits 58 and 59 and the selector valve 6. Accordingly, the poppet 53 of the logic valve is moved open against the action of the spring 55 by the pump discharge pressure flowing to the afore-mentioned first port 51, and the discharge oil is led from the first port 51 to the head-side oil chamber 42 of the cylinder 4 through the conduit 23. Consequently, the cylinder 4 is extended to lift up the load W. The oil in the rod-side oil chamber 41 of the cylinder 4 is returned to the tank 13 through the conduit 21 and the oil return conduit 12.

In this manner, when lifting up the load, the poppet 53 of the logic valve 5 is pushed open against the action of the spring 54 by the discharge oil pressure of the pump flowing into the first port 51, permitting the discharge oil to flow into the oil chamber 42 on the head side of the cylinder 4 through the logic valve 5. Therefore, there is no need for providing a check valve in parallel relation with the logic valve as in the conventional circuit, realizing a simplified circuit arrangement which is reduced in the number of parts and cost.

Figure 4:
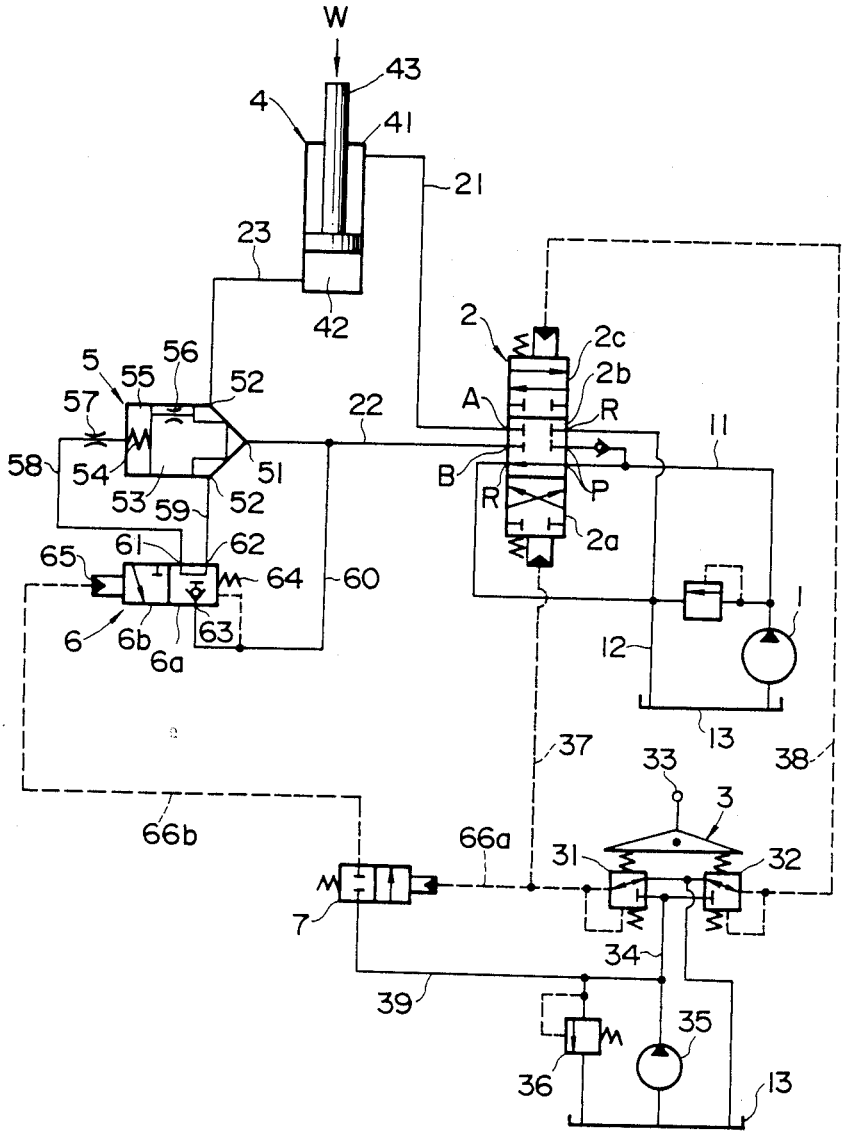
FIG. 4 is a hydraulic circuit diagram in another embodiment of the invention.

Illustrated in FIG. 4 is another embodiment of the invention, in which, when lowering load W, an auxiliary change-over valve 7 is switched to communicating position by pilot pressure which is fed to the pilot conduit 66*a* from the variable reducing valve 31 according to the extent of lever manipulation. As a result, the primary pressure of the pilot operating valve 3 is led from the conduit 39 to the pilot port 65 of the selector valve 6 through the conduit 66*b* to switch the selector valve 6 to the left position 6*b* in the drawing. In this embodiment, the selector valve 6 is switched in a more secure manner.

Namely, in case of a selector valve 6 constructed as shown in FIG. 2, the leftward and rightward forces FL and FR acting on the spool 67*b* are balanced when the spool and seat diameters dO and dS are in the relationship of $dO=dS$, requiring the spring 64 to have relatively a small force for closing the seat 68. Should the just-mentioned relationship become $dO<dS$ afterwards due to abrasion of the seat 68, for example, the force FR acting rightward on the spool 67 would become greater ($FR>FL$), opening the seat portion 68. This can be prevented by employing spring 64 with greater force. However, in such a case, there arises a problem that the pilot pressure from the variable reducing valve 31 of the pilot operating valve 3 might fail to switch the spool 67*b*. Therefore, as shown particularly in FIG. 4, the primary pressure from the variable reducing valve 31 is led to the pilot port 65 of the selector valve 6 by means of the auxiliary change-over valve 7 to switch same more securely. The auxiliary change-over valve 7 which is of a small size and can be switched appropriately by a low pilot pressure, which contributes to improve the maneuverability and controllability all the more.

The direction control valve 2 may be either a manual type or an electromagnetic type. If desired, the selector valve 6 may also be of an electromagnetic type. In such a case, a switch, a delay circuit or the like is provided such that, in relation with the operating lever of the direction control valve 2, the selector valve 6 is switched in the initial phase of the switching to the load lowering position.

Although the load W is pushed up by extension of the cylinder 4 in the foregoing embodiments, the cylinder 4 may be employed in a reversed fashion to pull up the load W upon contraction. In such a case, the conduits 23 and 21 are connected to the rod-side oil chamber 41 and the head-side oil chamber 42 of the cylinder 4, respectively.

It will be appreciated from the foregoing description that, according to the present invention, the spring chamber of the logic valve is communicated with the conduit between the first port of the logic valve and the direction control valve when lowering the load to prevent hunting. This eliminates the need for a damping means or a check valve for the logic valve, and makes it possible to simplify the construction with a reduced number of component parts and a lower production cost. Besides, the lowering of load can be initiated smoothly without a momentary drop of the load in the initial stage of the lowering operation.

Further, as the direction control valve is switched after switching the selector valve, the load lowering speed in the succeeding lowering operation can be appropriately controlled according to the spool opening degree of the direction control valve, ensuring improved maneuverability and controllability.

Moreover, the selector valve which is constituted by a seat valve precludes oil leaks, holding the cylinder securely in stop position and prevents spontaneous drop of load in a reliable manner, improving the safety of operation to a marked degree.

What is claimed is:

1. A hydraulic circuit for a cylinder in a hydraulic power transmission for controlling pressurized oil flow to and from two oil chambers including a load holding oil chamber and a load lowering oil chamber in the cylinder, comprising:

a directional control valve in communication with a pressurized oil source and connected between said pressurized oil source and said two oil chambers a logic valve connected between said directional control valve and said load-holding oil chamber in said cylinder, said logic valve having first and second ports connected to said directional control valve and to said load-holding oil chamber, respectively;

a selector valve having means for communicating a spring chamber of said logic valve with a conduit between said first port and said directional control valve when said directional control valve is switched to a position wherein pressurized oil is supplied to said load lowering chamber of said cylinder and having means for communicating said spring chamber with said second port in at least one other operational phase, including a pilot operating valve wherein said selector valve and said directional control valve comprise pilot change-over valves switchable by pilot pressure from a pilot operating valve, wherein the pilot pressure sufficient for switching said selector valve is preset at a level lower than the pilot pressure sufficient for switching said directional control valve.

2. A hydraulic circuit as defined in claim 1, wherein said selector valve comprises valve having a seat.

3. A hydraulic circuit for a cylinder in a hydraulic power transmission for controlling pressurized oil flow to and from two oil chambers including a load holding oil chamber and a load lowering oil chamber in the cylinder, comprising:

a directional control valve in communication with a pressurized oil source and connected between said pressurized oil source and said two oil chambers:

a logic valve connected between directional control valve and said load-holding oil chamber in said cylinder, said logic valve having first and second ports connected to said directional control valve and to said load-holding oil chamber, respectively;

a selector valve having means for communicating a spring chamber of said logic valve with a conduit between said first port and said directional control valve when said directional control valve is switched to a position by said pilot operating valve wherein pressurized oil is supplied to said load lowering chamber of said cylinder and having means for communicating said spring chamber with said second port in at least one other operational phase, including a pilot operating valve, wherein said directional control valve comprises a pilot change-over valve switchable by pilot pressure from said pilot operating valve, wherein said selector valve comprises a pilot change-over valve switchable by a primary pressure of said pilot operating valve, including an auxiliary change-over valve connected between said selector valve and said primary pressure of said pilot operating valve for controlling said primary pressure to said selector valve, said auxiliary change-over valve being switchable by said pilot pressure from said pilot operating valve.

4. A hydraulic circuit as defined in claim 3, wherein said selector valve comprises a valve having a seat.

* * * * *